United States Patent [19]

Wolter

[11] 4,098,104

[45] Jul. 4, 1978

[54] REVERSIBLE-FLAT KEY FOR A CYLINDER LOCK

[75] Inventor: Heinz Wolter, Cologne, Fed. Rep. of Germany

[73] Assignee: DOM-Sicherheitstechnik GmbH & Co. KG, Brühl, Fed. Rep. of Germany

[21] Appl. No.: 717,605

[22] Filed: Aug. 26, 1976

[30] Foreign Application Priority Data

Sep. 19, 1975 [DE] Fed. Rep. of Germany ..... 2541808
Feb. 19, 1976 [DE] Fed. Rep. of Germany ..... 2606557

[51] Int. Cl.[2] ..... E05B 19/04; E05B 27/06
[52] U.S. Cl. ..... 70/406; 70/366
[58] Field of Search ..... 70/358, 364 A, 378, 70/405, 406

[56] References Cited

U.S. PATENT DOCUMENTS

| | | | |
|---|---|---|---|
| 3,412,588 | 11/1968 | Schwegler | 70/358 |
| 3,824,818 | 7/1974 | Neale | 70/358 |
| 3,974,670 | 8/1976 | Wolter | 70/364 A |

*Primary Examiner*—Robert L. Wolfe
*Attorney, Agent, or Firm*—Martin A. Farber

[57] ABSTRACT

A reversible flat key for cylinder locks, having lead-in bevels at the tip of the key, and with double rows of recesses for arranging the tumbler pins in proper order, arranged on each wide side of the key, wherein the double row of recesses on one wide side of the key is arranged offset in the transverse direction relative to the double row of recesses on the opposite wide side of the key, and the lead-in bevels are arranged off set relative to one another, the bevels being formed respectively as individual grooves extending over the longitudinal center plane of the key.

9 Claims, 14 Drawing Figures

6
44
30
33
32
33
KA
A
A
3
29
31

7
5
2
44
3
33
33'
1
31
y/8
KA
SA
y
4
6
44
29
33'

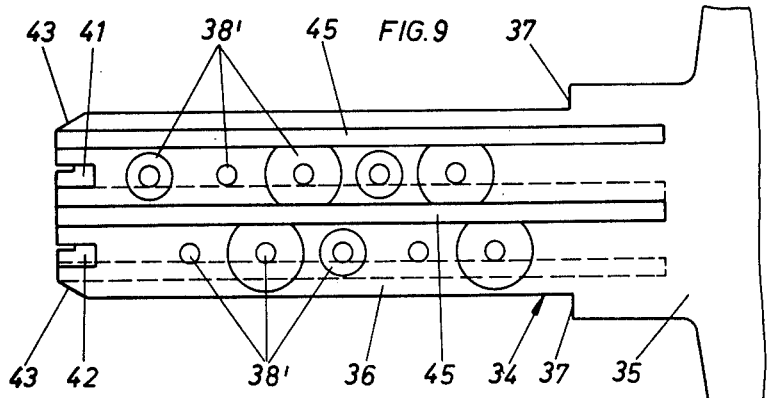
FIG. 9
FIG. 10
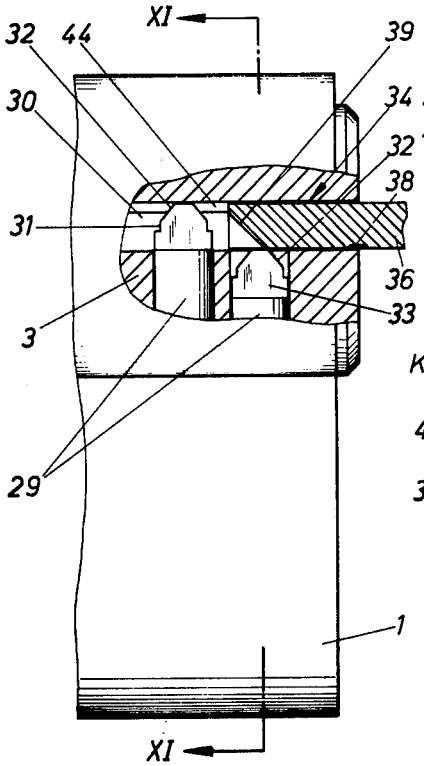
FIG. 11
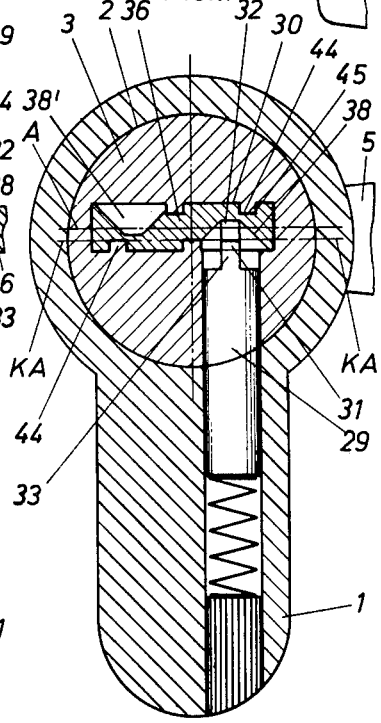

REVERSIBLE-FLAT KEY FOR A CYLINDER LOCK

The present invention relates to a reversible flat key for cylinder locks, with lead-in bevels at the tip of the key, and with double rows of recesses for arranging the tumbler pins in proper order, arranged on both wide sides of the key.

With one known construction according to this generic type (German Offenlegeschrift No. 1 812 053), the flat key is bevelled roof shaped on its front end face. According to the insertion position of the reversible flat key, the tumbler pins are engaged and displaced by one lead-in bevel. In order to achieve an additional security, grooves are provided on the narrow sides, which grooves open towards the key end and which grooves cooperate with a correspondingly formed rib of the cylinder core. By means of this measure the construction of the cylinder lock is more expensive. Beyond that it is critical to select several adjacent recesses of the double rows to be of maximum depth since this encourages a possible buckling or indeed breaking of the key shaft.

Further it has been proposed to provide lead-in bevels at the tip side on reversible flat keys, which run up to the opposite wide side of the key. However this design relates to a cylinder lock with only one row of tumbler pins.

It is an object of the present invention to form a reversible flat key, of the introductory-mentioned generic type for a cylinder lock which can be inserted in the key channel in both reversible positions with at least an equally large number of permutation possibilities, yet with greater key strength, now as a consequence of a particular profile or shape of the lead-in bevels.

The above mentioned object is aided in its solution in accordance with another object of the present invention by providing a reversible key of the introductory mentioned type characterized in the manner that the double row (I, II) of recesses of one side (S1) of the key is arranged offset in cross-section relative to the double row (I', II') of recesses of the opposite wide side (S 2) of the key, and the lead-in bevels (17–20 or 39–42) are arranged staggered offset relative to one another, the lead-in bevels being formed respectively as individual grooves extending over or past the longitudinal center plane (Z—Z) of the key.

By such formation, an introductory type reversible flat key for a cylinder lock is provided, which on the one hand is distinguished by manufacturing advantages, and on the other hand by technical advantages during use. An additional security is now achieved by the profiling of the lead-in bevels without additional construction parts on the cylinder lock being necessary. This reduces the manufacturing costs. If the permutation possibilities still are to be further increased, one can select the introductory mentioned security, comprising ribs of the cylinder core and grooves of the key, without this leading to a handicap or damage of the key. Moreover, in order to still increase the permutation possibilities additional tumbler pins can be provided which are held or trapped in the cylinder core, and which cooperate with corresponding recesses of the key. The double rows of the recesses on the opposite wide sides of the keys, which rows lie offset relative to one another in the cross-wise direction, permit several adjacent recesses to be made with maximum depth, without leading to a dangerous weakening of the key shaft. By offsetting of the double rows with respect to one another, also the lead-in bevels can extend beyond the longitudinal center plane of the key. This brings the advantage that the tip of the core tumbler pins, with a not inserted reversible flat key, can lie on the other or far side of the longitudinal center plane of the keyway channel. A reversible flat key, which is not equipped with the corresponding lead-in bevels then is shut out. This fact makes it possibly to employ the formation in accordance with the present invention, e.g., in the field of a master key system. The tip of the core pin tumblers of the individual cylinder locks is formed normally, whereas the individual keys possess lead-in bevels which are roof-shaped relative to one another. On the other hand, the tip of the core tumbler pins of the master cylinder lock begins on the other side of the longitudinal center plane of the keyway channel, and the master key is provided with corresponding lead-in bevels or ascending inclinations. The latter can thus close all cylinder locks; the superordinated master cylinder lock to the contrary shuts out the individual keys. Thus it is not possible to make a suitable corresponding master key from an individual key, in case the key tip is used for control functions, as for example the shifting of a coupling member. Should the lead-in bevels be produced on the individual keys, the roof-shaped tip has to be filed off. Only then are the lead-in bevels allowed to be produced. However then the master key, which is produced in this manner, is too short in order to still be able to actuate the cylinder lock. Also only the key which is equipped with the corresponding profiling of the front end of the key tip can be inserted into the key channel. The profiling or shaping need not extend over the entire shaft of the key as with those cylinder locks by which the flat key has the recesses which arrange the tumbler pins in proper order on one of the narrow edge sides. The front end of the key tip which is formed as a wavy line cannot be made by a house-breaker if only the cylinder lock is present. During insertion of the key one of the narrow sides of the key, respectively, forms a slide surface engaging the core bore - inner wall of the cylinder housing, whereby the key obtains an exact guidance during the insertion. The step-shaped set-off or reduced core tumbler pins in connection with the terminal waved line on the front side of the key tip permit an unhindered insertion of the key.

Another embodiment according to the invention is featured in that, despite lead-in bevels extending beyond the longitudinal central plane of the key, the reversible flat key possesses a smaller key shaft width. This signifies that at the same time the keyway channel can be enclosed all around, despite lateral offsetting in relation to the core axis. Attempts at opening, by increased exertion of force on the cylinder core, thus remain completely ineffective. Furthermore, an unauthorized duplication of such reversible flat keys is made more difficult. Already with slight deviations in the form of the key tip, the insertion of the reversible flat key is blocked. The smaller width of the key shaft results from the fact that no key material remains between two adjacent individual grooves. The cross-sections of the individual grooves even can penetrate one another, so that yet a smaller width of the key shaft can be achieved. The special shaping of the ends of the core tumblers which extend into the keyway permits insertion of only a reversible flat key which has the correspondingly dimensioned individual grooves. By the offset arrangement of the keyway channel with respect to the cylinder core axis, in spite of flat ribs the core tumblers receive a good guidance in the core tumbler bores. During insertion of the key, even if the core tumblers are forced to tilt, no binding can arise as a result. The manufacturing costs of the cylinder core are not increased by these measures. The off-setting of the keyway channel is chosen of a size such that on the one hand, a good guidance is insured for the core tumblers, and on the other hand there is achieved a circumferentially enclosed keyway.

With the above and other objects and advantages in view the present invention will become more clearly understood in connection with preferred embodiments of the present invention when considered with the accompanying drawings, of which:

FIG. 9 is a plan view of the flat key of FIG. 7;

FIG. 10 is a partial elevational view toward the cylinder lock partially broken away, during the insertion of the flat key;

FIG. 11 is a section along the lines XI—XI of FIG. 10, however with the flat key completely inserted;

Figure 1:
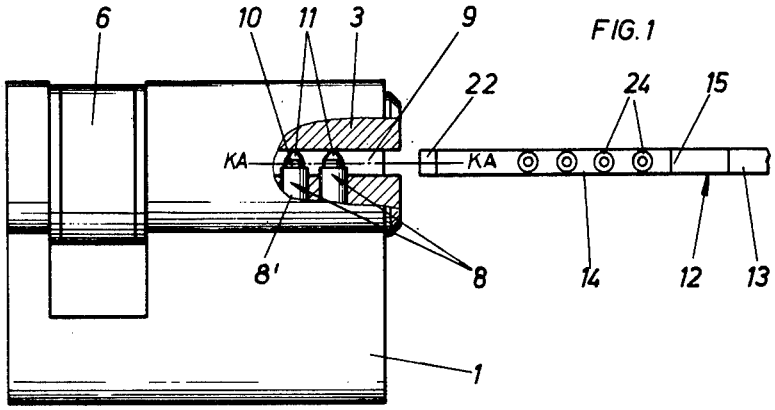
FIG. 1 is a side elevational view showing a reversible flat key in accordance with the present invention before insertion in the cylinder lock, the latter being partly broken away in longitudinal section.

Referring now to the drawings and more particularly to FIGS. 1–6, a cylinder lock of both the embodiments comprises the cylinder housing 1, which receives the rotatable cylinder core 3 in a core bore 2. A coupling member 4 is arranged coaxially to the cylinder core 3, and non-rotatably connected relative to the cylinder core 3, i.e., connected rotatably so as to turn together. The coupling member 4 carries the hub 6, the latter having the locking lug 5. The locking lug 6 and the coupling member 4 are connected non-rotatably relative to one another i.e., they are connected so as to rotate together, by means of the cross pin 7. That is the drive of the locking lug 5 takes place by means of the pin 6. The coupling piece 4 carries the locking lug 5.

In the cylinder lock, which is formed as and constitutes a profile cylinder lock, there are provided two adjacent rows of offset or staggered pin tumblers, the rows lying outside of the longitudinal center plane of the lock. The pin tumblers extend inside of the projecting flange of the cylinder housing 1 and into the cylinder core 3.

Figure 2:
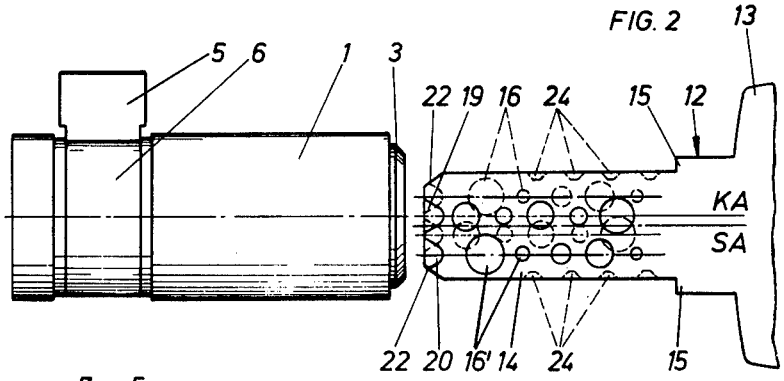
FIG. 2 is a plan view of FIG. 1.
Figure 3:
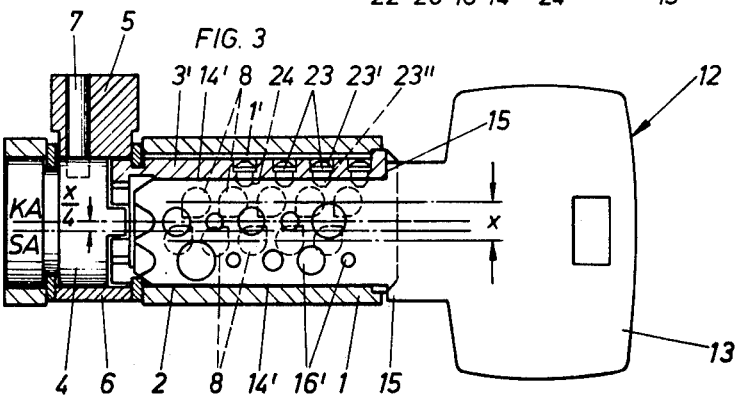
FIG. 3 is a longitudinal section through the cylinder lock with the inserted reversible flat key.
Figure 4:
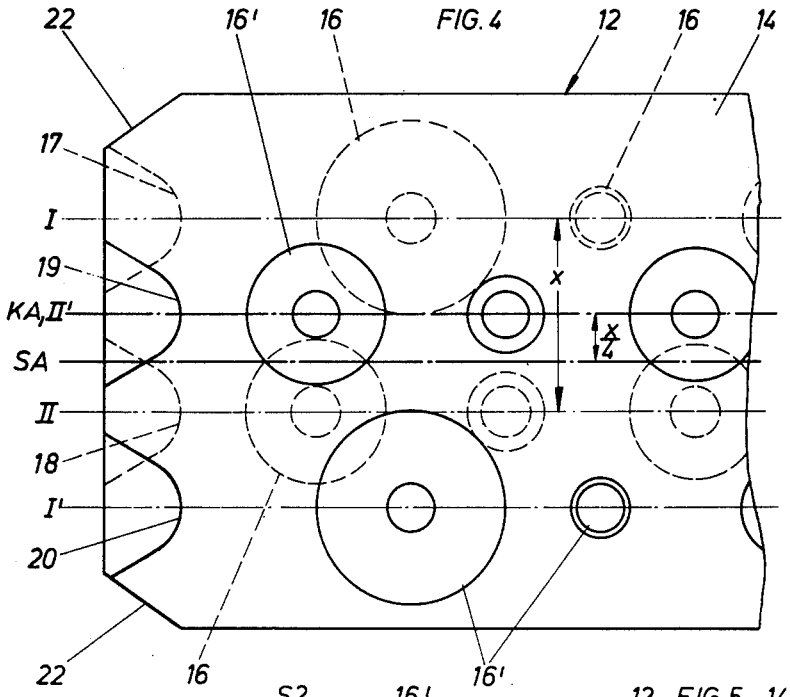
FIG. 4 is a greatly enlarged broken away elevational view of the end stem section of the key shaft.
Figure 5:
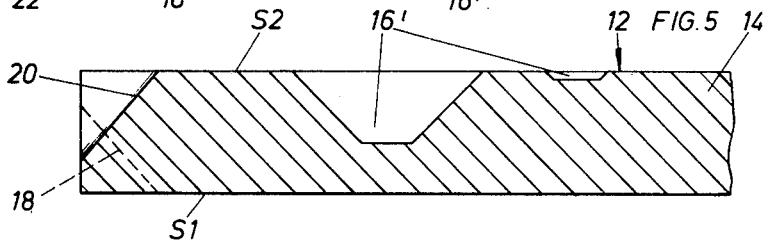
FIG. 5 is a longitudinal section through the key shaft in the range of one row of recesses.

The tumbler pins comprise in the embodiment of the cylinder lock illustrated in FIGS. 1–3, spring-loaded housing tumbler pins (not illustrated) and core tumbler pins 8. As may be seen from FIG. 3, the cylinderical jacket surface of the core tumbler pins 8, as well as that of the housing tumbler pins, transfer tangentially into two flat surfaces which meet on one edge facing the longitudinal center plane of the housing. That is the cylindrical surface of each tumbler pin becomes tangential with two flat surfaces meeting at one edge pointing to the longitudinal center plane of the housing. One of the flat surface lies transverse or cross-wise to the longitudinal direction of the cylinder housing and the other flat surface extends in the longitudinal direction of the latter. The mounting or guide bores which receive the tumbler pins, respectively, are correspondingly shaped complimentary to the cross-sectional shape of the tumbler pins. In this manner the tumbler pins are non-rotatably arranged in the mounting bores.

As illustrated in FIG. 1, the core tumbler pins 8 with their ends projecting in the key channel 9 transfer into a step-shaped set-off tapering or reduced contracted portion 10. The latter extends beyond the center plane of the keyway channel, this plane passing through the core axis KA, and continues in the cone shaped tip 11.

The core tumbler pins 8 which slide with their guide ends 8' in the cylinder core are abuttingly supported on the wall of the keyway channel opposite them.

The two tumbler pin rows are arranged symmetrically relative to the core axis KA. The distance or spacing of the two tumber pin rows is designated with the reference character $x$. The flat key 12 belonging or corresponding to the cylinder lock comprises a key shaft or stem 14 which extends from the key handle 13. Abutment shoulders 15 are provided between the handle 13 and the key shaft 14, which shoulders limit the insertion of the key, comparing FIG. 3.

With the flat key 12 inserted, the key axis SA lies about $x/4$ offset relative to the core axis KA. The core axis KA then extends symmetrically to the two recess rows I and II of one of the wide sides S1 of the key. On the opposite wide side S2 of the key in correspondingly offset position relative to the key axis SA there are disposed the rows of recesses I' and II'. The core axis KA aligns itself with the recess row II'. In the illustrated position of the key, the dashed line recesses 16 of the hole rows I and II cooperate with the core tumbler pins, whereas the recesses 16' which are disposed on the other wide side of the key remain unused. If the flat key 12 is turned over (reversed) by 180°, the hole row II lies on the core axis KA, so that then the recesses 16' come into operation or action.

Figure 6:
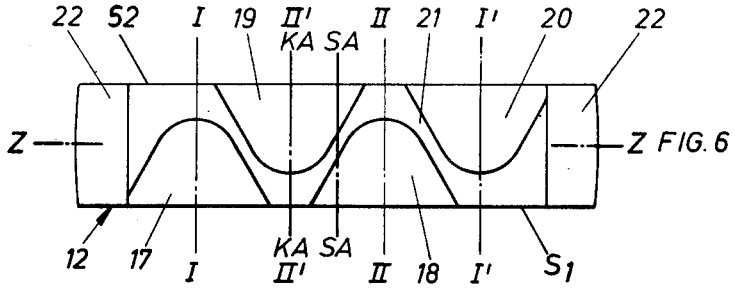
FIG. 6 is a front view of the point of the key.
Figure 7:
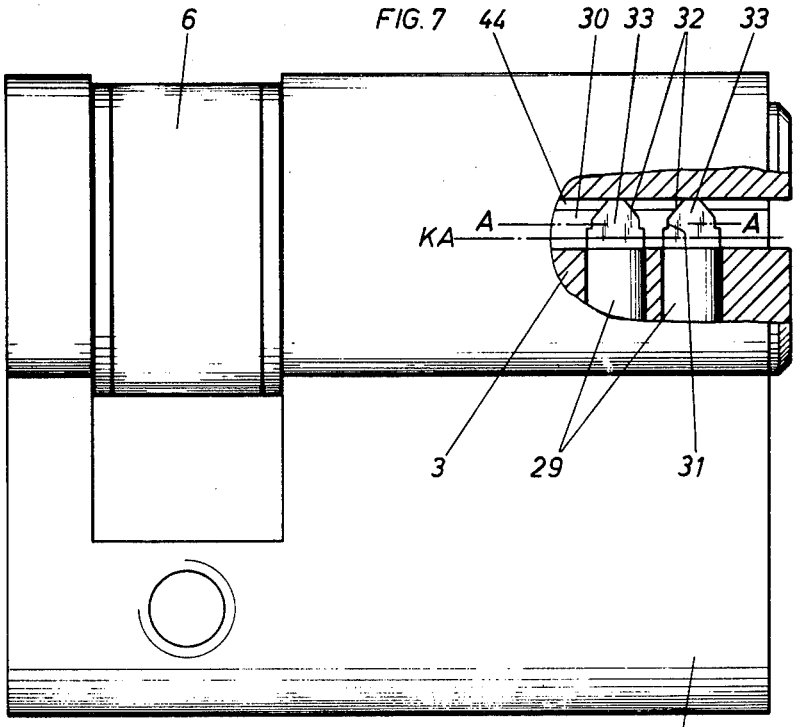
FIG. 7 is an enlarged side elevational view of the cylinder lock corresponding to the reversible flat key according to a second embodiment of the invention, broken away in part to show a longitudinal section.

Lead-in or ascending bevels or inclinations 17, 18, 19 and 20 are formed on the tip of the key which extend beyond the longitudinal center plane Z—Z of the key and are coordinated to the recess rows I, II, I' and II'. The lead-in rising bevels or inclinations are formed in the shape of individual grooves. As a consequence of the displaced offset arrangement of the rows of recesses, these lead-in bevels 17, 18, 19 and 20 are arranged staggered or offset relative to each other. As illustrated in FIG. 6, in the region of the front side or end surface of the key tip, the individual grooves form a waved undulating line 21.

The lead-in bevels 17–20 which are formed in the shape of individual grooves are adjusted in shape to match the tip of the core tumbler pins 8.

Inclinations or bevels 22 are provided on the front end of the key tip laterally alongside the lead-in bevels 17–20, which bevels 22 serve as insertion aids for the key shaft into the keyway channel.

As shown in FIG. 3, one of the narrow sides 14' of the key is supported abuttingly on the core bore inner wall of the cylinder housing 1. The other narrow side 14' is supported on the narrow keyway channel wall 3' of the tumbler pins. Additional trapped tumbler pins 23 are provided in this key channel wall 3'. The cross-sectionally enlarged heads 23' are mushroom-shaped and radially outwardly directed. A longitudinal groove 1' in the cylinder housing wall 1 is coordinated thereto. The ends 23'' of the additional pins 23, which ends 23'' point to the core axis KA, are frustoconically formed and project with an inserted key 12 into recesses 24 on the narrow sides of the key shaft. Since this deals with a reversible key, on both narrow sides of the key such recesses 24 provided. The additional pins 23 can yield or fall back into these recesses during turning of the cylinder core. If these recesses were absent, the cylinder core is not able to turn.

The additional pins 23 in connection with the grooved shaped lead-in bevels 17–20 make it more difficult to make an unauthorized duplication of the key.

Moreover still further additional tumbler pins can be provided. These would preferably be arranged at right angles or perpendicularly to the additional pins 23 in the cylinder core. The recesses in the key for the further additional tumbler pins could then be applied in the free region of the wide sides of the key adjacent the edge.

Referring now to the drawings and more particularly to the embodiment illustrated in FIGS. 7–14, the core tumbler pins 29 which project in the keyway channel 30 have a graduation step 31 in that range. On this there is connected a tapering tip 32 lying on the other side of the longitudinal center plane A—A of the keyway, with which tip 32 the core tumbler pin 29 abuts against the opposite keyway channel wall. The region of the tumbler core pins 29, which region projects in the key channel 30, is formed in the shape of a flat rib or step 33 extending in the longitudinal direction of the key channel 30. This is achieved by a flattening 33' on both sides, the size of which corresponds to the height of the key channel, noting FIG. 7.

In order to bestow a good guidance to the core tumbler pins 29 in spite of these flattenings 33', the longitudinal center plane A—A of the key channel is disposed in offset position with respect to the core axis KA, and indeed in the direction in which the tip 32 of the core tumbler pins points.

Figure 8:
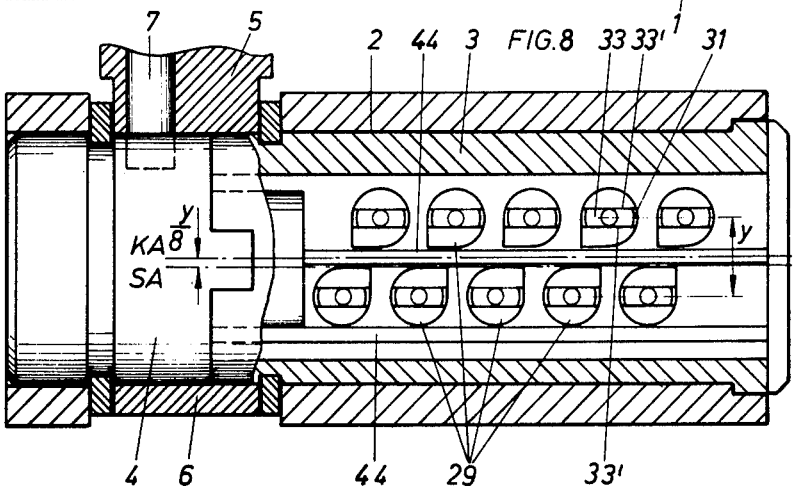
FIG. 8 is a longitudinal section through the cylinder lock in the range of the keyway channel.
Figure 12:
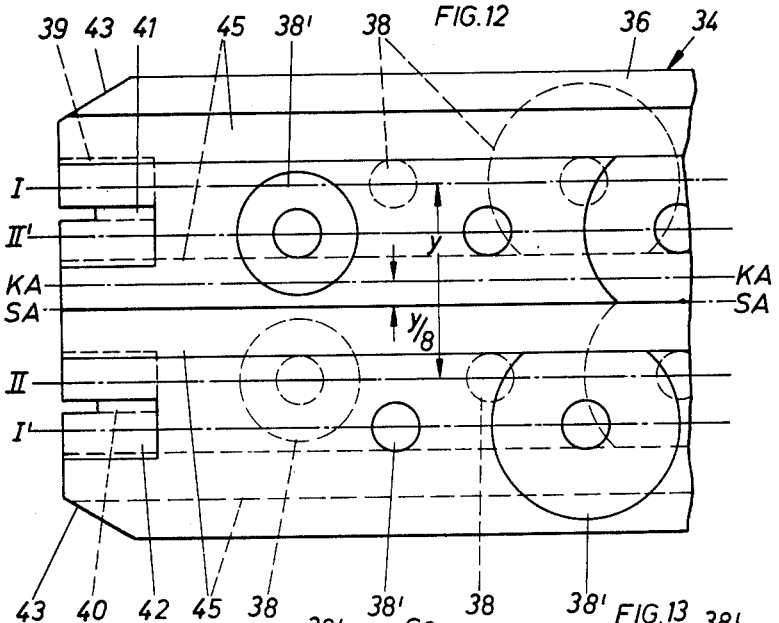
FIG. 12 is a greatly enlarged elevational view of the end section of the key shaft.
Figure 13:
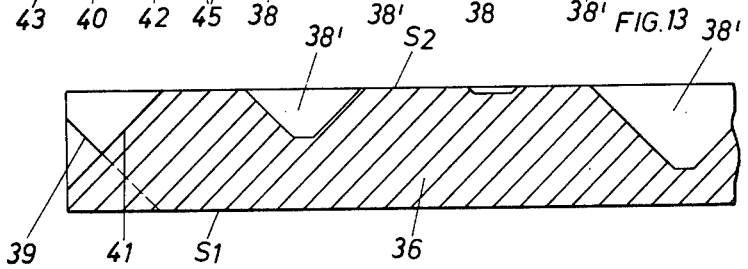
FIG. 13 is a longitudinal section through the key shaft through a row of recesses.

The two tumbler pin rows are as shown in FIG. 8 symmetrically arranged with respect to the core axis KA. The spacing of the two rows of tumbler pins is designated by the reference character $y$.

The reversible flat key 34 which corresponds to the cylinder lock has the key shaft 36 extending from the key handle 35. Abutment shoulders 37 are provided between the handle 35 and the key shaft 36 and serve as insertion limits for the key.

The longitudinal axis of the keyway channel, and the key axis SA, respectively, lies about 0.5 mm and $y/8$, respectively, displaced with respect to the core axis KA, which extends symmetrically relative to the two recess rows I and II of one of the wide sides S1 of the key.

On the opposite wide side S2 of the key the recess rows I' and II' are disposed in correspondingly offset positions relative to the key axis SA.

If the reversible flat key in the illustrated position is inserted in the cylinder core, the dashed line indicated recesses 38 of the hole rows I and II cooperate with the core tumbler pins 29, whereas the recesses 38' which are disposed on the other wide side of the key remain unused. If the flat key 34 is reversed by 180° the reccesses 38' of the hole rows I' and II' come into action.

The lead-in bevels 39–42 which extend over or beyond the longitudinal center plane Z—Z of the key are coordinated to the recess rows I, II, I' and II'. The lead-in bevels 39–42 are formed in the shape of offset arranged single or individual grooves with a width of approximately more than 1 mm. The cross-section of these individual grooves is somewhat larger than the width of the flat ribs 33 of the core tumbler pins 29.

Figure 14:
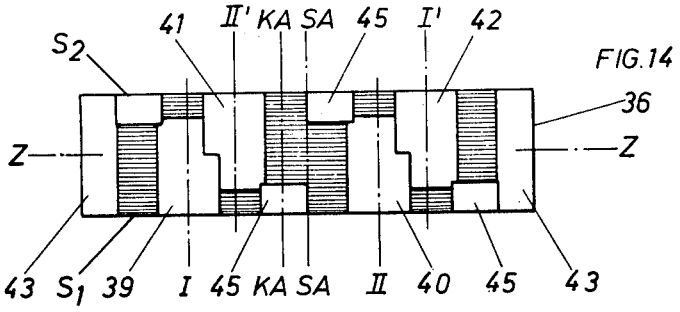
FIG. 14 is a front view of the tip of the key.

As FIG. 14 particularly shows, the cross-section of two adjacent single grooves 39, 41, and 40, 42 belonging respectively to the opposite recess rows transfer or pass into one another. They can also penetrate through each other.

During the insertion of the reversible flat key, the core tumbler pins 29 are displaced in the downward direction by the lead-in bevels or ascending inclinations. A key in which the lead-in bevels begin for example at the longitudinal center plane of the key, can not thus arrange the tumbler pins in proper order nor operate the tumblers.

The key tip is formed with bevels or inclinations 43 which are laterally disposed to the lead-in bevels. The inclinations 43 serve as insertion aid means for the insertion of the key shaft into the key channel 30.

In order to achieve a higher security, the cylinder core forms longitudinal ribs 44 which project into the keyway channel 30. The key shaft is thus correspondingly equipped with grooves or slots 45, which grooves 45 are arranged on both wide sides S1 and S2 of the key.

I claim:

1. A reversible flat key for cylinder locks, comprising a key shaft having opposite wide sides and a tip of the key shaft, said tip being formed with lead-in bevels extending from said opposite wide sides of the key shaft, said key shaft being formed with two rows of recesses reversibly identically arranged on each of the wide sides of the key shaft, said two rows of recesses of both said wide sides being adapted to arrange tumbler pins of a cylinder lock in proper order, respectively, said two rows of recesses on one of said wide sides of the key shaft being arranged offset in a transverse direction of the key shaft relative to the two rows of recesses on the opposite wide side of the key shaft, respectively, and adjacent of said lead-in bevels extending from opposite wide sides being aligned with corresponding opposite of said rows of recesses on said opposite wide sides of the key shaft and being arranged offset relative to each another, said lead-in bevels being formed as individual grooves, respectively, each extending from one of the wide sides to the opposite wide side, respectively, beyond a longitudinal center plane of the key shaft, the longitudinal center plane being substantially parallel to the wide sides of the key shaft.

2. The reversible key as set forth in claim 1, wherein said lead-in bevels are arranged offset relative to one another such that a front end surface of said tip of the key shaft is formed as a waved line by means of said individual grooves.

3. A reversible flat key for cylinder locks, comprising a key shaft having opposite wide sides and a tip of the key shaft, said tip being formed with lead-in bevels, said key shaft being formed with two rows of recesses arranged on each of the wide sides of the key shaft, said two rows of recesses being adapted to arrange tumbler pins of a cylinder lock in proper order, respectively, said two rows of recesses on one of said wide sides of the key shaft being arranged offset in a transverse direction of the key shaft relative to the two rows of recesses on the opposite wide side of the key shaft, said lead-in bevels being arranged offset relative to each another, said lead-in bevels being formed as individual grooves, respectively, each extending from one side to the other side, respectively, beyond a longitudinal center plane of the key shaft, the longitudinal center plane being substantially parallel to the wide sides of the key shaft, the cross-sections of two adjacent of the individual grooves, respectively, are aligned with opposite of said rows of recesses on said opposite wide sides of the key shaft, respectively, and said two adjacent individual grooves extend into each other.

4. The reversible flat key, as set forth in claim 3, wherein the cross-sections of said adjacent individual grooves penetrate each other.

5. A cylinder lock for a reversible flat key as set forth in claim 1, including a core cylinder forming therein a longitudinal keyway channel, core tumbler pins having guide ends displaceably mounted in said cylinder core, said core tumbler pins each being formed with a step-wise narrowed portion opposite said guide ends, said step-wise narrowed portions projecting totally in said keyway channel and extending beyond a longitudinal center plane of the keyway channel and cooperating with said lead-in bevels during insertion of said key shaft, a tip of each of said core tumbler pins is connected to said narrowed portion.

6. The cylinder lock for a reversible flat key as set forth in claim 3, comprising a cylinder core forming a longitudinal keyway channel, core tumbler pins displaceably mounted in said cylinder core, said core tumbler pins each have a tip extending over a longitudinal center plane of the keyway channel, said core tumbler pins each have an end adjacent said keyway channel formed in the shape of a flat rib extending along the longitudinal direction of said keyway channel.

7. The cylinder lock as set forth in claim 6, wherein the longitudinal center plane of said keyway channel is arranged offset relative to the axis of the cylinder core in a direction in which the tips of the core tumbler pins point.

8. A reversible flat key for cylinder locks, comprising a key shaft having opposite wide sides and a tip of the key shaft, said tip being formed with lead-in bevels, said key shaft being formed with two rows of recesses arranged on each of the wide sides of the key shaft, said two rows of recesses being adapted to arrange tumbler pins of a cylinder lock in proper order, respectively, said two rows of recesses on one of said wide sides of the key shaft being arranged offset in a transverse diection of the key shaft relative to the two rows of recesses on the opposite wide side of the key shaft, and said lead-in bevels being arranged offset relative to each another, said lead-in bevels being formed as individual grooves, respectively, each extending from one side to the other side, respectively, beyond a longitudinal center plane of the key shaft, the longitudinal center plane being substantially parallel to the wide sides of the key shaft, said lead-in bevels are aligned respectively with said rows of recesses, respectively.

9. The reversible flat key for cylinder locks as set forth in claim 1, wherein said key shaft defines a key axis, said two rows of recesses on each wide side of the key shaft are disposed in correspondingly offset positions relative to said key axis.

* * * * *